United States Patent [19]

Kemp

[11] 3,943,877

[45] Mar. 16, 1976

[54] OUTBOARD MOTOR MOUNTING SYSTEM

[76] Inventor: Kenneth C. Kemp, 3157 E Ave. I No. A4, Lancaster, Calif. 93534

[22] Filed: Feb. 6, 1975

[21] Appl. No.: 547,562

[52] U.S. Cl. ..... 115/17; 248/4
[51] Int. Cl.[2] ..... B63H 21/26
[58] Field of Search ..... 115/17, 18 R; 248/4

[56] References Cited

UNITED STATES PATENTS

| | | | |
|---|---|---|---|
| 2,660,385 | 11/1953 | Moran | 248/4 |
| 3,003,725 | 10/1961 | Woolbright | 248/4 |
| 3,025,028 | 3/1962 | Corbin, Jr. et al. | 248/4 |
| 3,106,375 | 10/1963 | Donaldson | 248/4 |

*Primary Examiner*—Trygve M. Blix
*Assistant Examiner*—Sherman D. Basinger
*Attorney, Agent, or Firm*—Wolfe, Hubbard, Leydig, Voit & Osann, Ltd.

[57] ABSTRACT

A protective mounting plate arrangement for removably supporting an outboard motor on a boat transom. One protective plate mounted on the rear side of the transom is formed with a pair of recessed vertical grooves for receiving and guiding arms of a motor clamp into precise predetermined position. Secured to the forward side of the transom are plates which define a pair of recesses for receiving the screw heads of the motor clamp. Such mounting plate arrangement protects the transom from scarring and damage during mounting of the motor and precisely orients and positively retains the motor in its desired operating position.

3 Claims, 5 Drawing Figures

OUTBOARD MOTOR MOUNTING SYSTEM

DESCRIPTION OF THE INVENTION

The present invention relates to outboard motor mountings, and more particularly, to a protective mounting plate arrangement adapted to be secured to the transom of a boat for removably supporting an outboard motor.

It is an object of the invention to provide an improved outboard motor mounting plate arrangement for a boat transom which facilitates placement of the motor onto the transom and precisely locates and retains the motor at the same position each time the motor is used.

Another object is to provide a mounting plate arrangement as characterized above which prevents scarring or other damage to the transom during placement or removal of the outboard motor onto the boat.

A further object is to provide a mounting plate arrangement of the above kind which positively retains a motor secured thereon from even slight disorientation due to vibrations during long periods of use.

Other objects and advantages of the invention will become apparent from the following detailed description taken in connection with the accompanying drawings, wherein.

Figure 1:
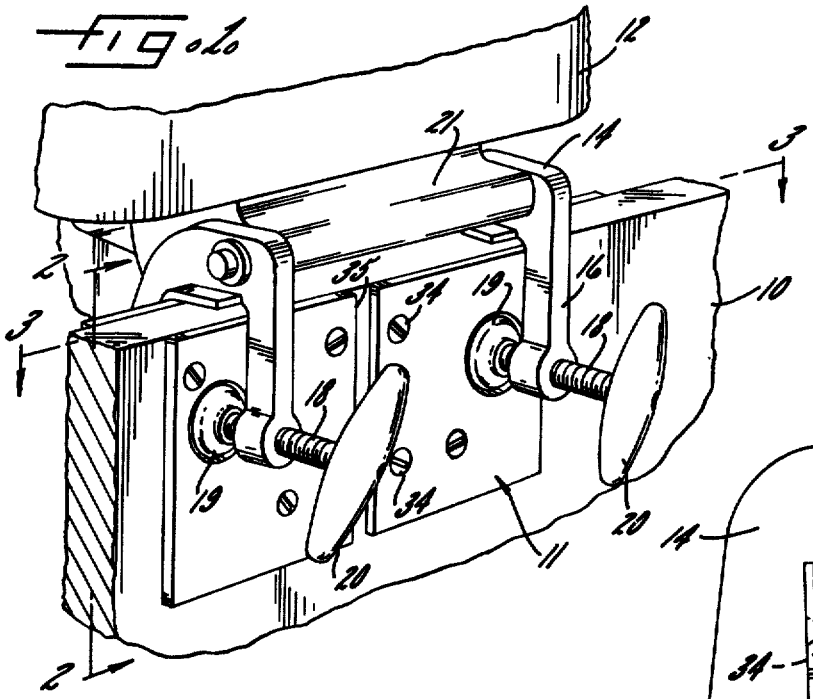
FIG. 1 is a fragmentary perspective view of a boat transom equipped with a mounting plate arrangement of the present invention and having an outboard motor secured thereto.
Figure 2:
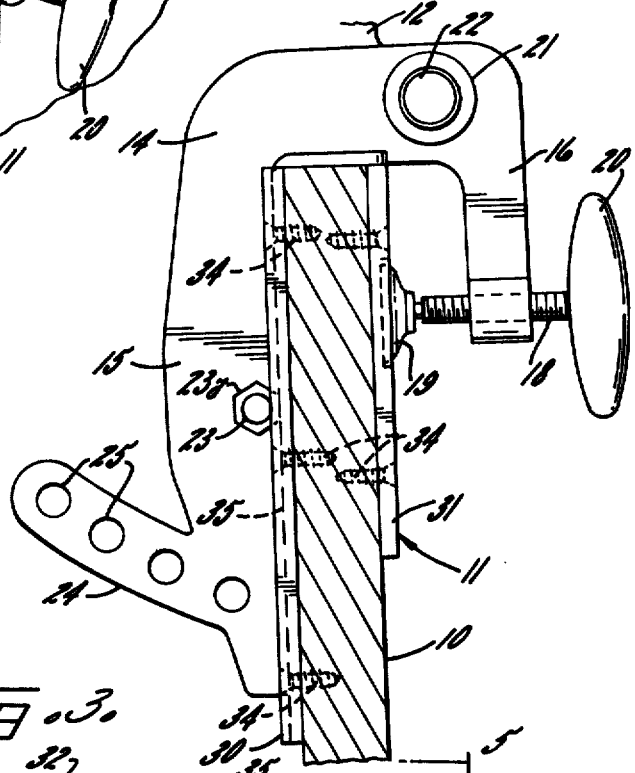
FIG. 2 is an enlarged fragmentary section of the illustrated transom and mounting plate arrangement taken in the plane of line 2—2 in FIG. 1.
Figure 4:
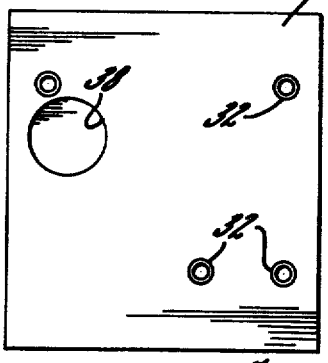
FIG. 4 is an enlarged plan view of one of the mounting plates on the inside or forward side of the transom taken in the plane of line 4—4 in FIG. 3.
Figure 3:
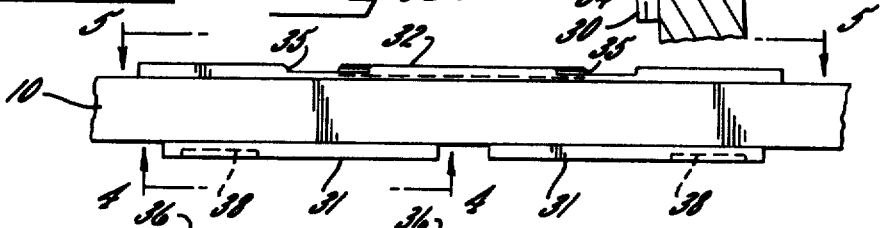
FIG. 3 is an enlarged top view of the illustrated transom and mounting plate arrangement taken in the plane of line 3—3 in FIG. 1.
Figure 5:
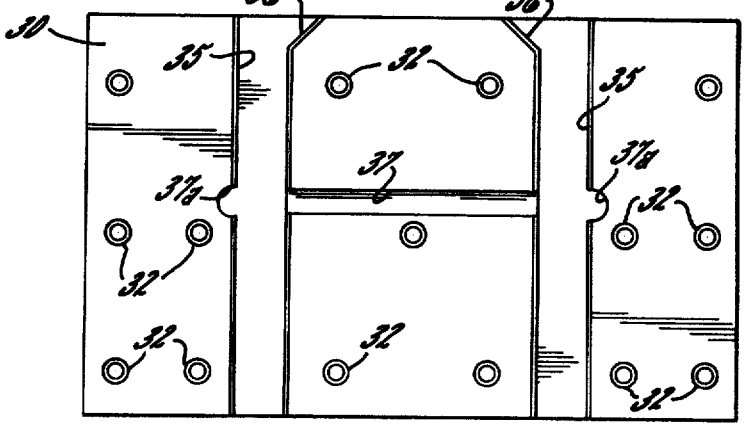
FIG. 5 is a plan view of the mounting plate on the rear side of the transom taken in the plane of line 5—5 in FIG. 3.

While the invention is susceptible of various modifications and alternative constructions, a preferred embodiment has been shown in the drawings and will be described below in detail. It should be understood, however, that there is no intention to limit the invention to the specific form disclosed, but, on the contrary, the intention is to cover all modifications, alternative constructions and equivalents falling within the spirit and scope of the invention.

Turning now more particularly to the drawings, there is shown a boat transom 10 having a mounting plate arrangement 11 embodying the invention with a typical outboard motor 12 removably positioned thereon. The motor 12 has U-shaped clamps 14 of the usual type which each include a substantially flat arm portion 15 for engaging the rear side of the transom 10 and a front arm portion 16 with a clamping screw 18 carried therein. The clamping screws 18 each threadably engage their respective arm 16 and have an enlarged circular head 19 for clamping engagement with the inside of the transom. A handle 20 at the opposite end of each screw 18 facilitates its rotational adjustment. The clamps 14 are mounted at opposite ends of a pivot rod 22 which extends through a sleeve 21 fixed to the motor 12. The motor 12 may thereby be pivoted about the rod 22 relative to the clamps 14 and transom 10. To enhance the rigidity of the straight legs 15 of the clamps 14, a bolt 23 is connected between the straight legs and secured in place by nuts 23*a*. The straight leg 15 of each clamp also is provided with a protruding flange 24 having a series of apertures 25 arranged in a radial array for the purpose of permitting the motor to be secured at any one of several pivoted positions by a suitable pin.

In accordance with the invention, protective mounting plates are secured on both front and rear sides of the transom and serve to facilitate positioning of the motor onto the transom at exactly the same location each time the motor is used and positively retain the motor in such position during even prolonged use. In the illustrated embodiment, a single large rectangular plate 30 is mounted on the rear side of the transom 10 and a pair of plates 31 are mounted on the inside or front side of the transom. The plates 30, 31 each are mounted on the transom with their upper surfaces substantially flush with the upper surface of the transom, and preferably are made of a relatively hard material, such as a lightweight metal. The plates 30, 31 have a plurality of apertures 32 that permit them to be secured to the transom by screws 34. The apertures 32 in this case each are countersunk so that the screw heads are flush with the outer surface of the plates.

In keeping with the invention, the rear plate 30 is provided with a pair of spaced vertical recessed grooves 35 for receiving the straight motor clamp arms 15 and guiding their movement such that the motor is properly and precisely centered on the transom. In order to insure that the clamp arms 15 are directed into the grooves 35, the upper end of each groove is flared outwardly to form a camming surface 36. The rear plate 30 is further formed with a horizontal groove 37 and semicircular recesses 37*a* disposed opposite the ends of the horizontal groove 37. The horizontal groove 37 will receive the bolt 23 and the recesses 37*a* will receive a respective one of the nuts 23*a* so as to permit the motor clamp to be mounted flush with the transom mounting plates. The inside protective plates 31 also each are formed with a circular recessed area 38 adapted to receive the head 19 of the respective screw clamp 18 when the motor is being secured in proper position on the transom. It will be understood that the plates 30, 31 may be designed such that the motor will be located in position for optimum operation each time it is mounted on the boat.

From the foregoing, it will be seen that since both the inner plates 31 and the outer plate 30 are substantially flush with the top of the transom 10, the transom is protected by the plates from scarring or damage which otherwise occurs from frequent removal and replacement of the motor onto the boat. The vertical slots 35 in the rear plate 30 also greatly facilitates positioning of the motor to its precise operating location on the transom. Furthermore, the vertical slots 35, together with the screw clamp receiving recesses 38, positively retain a motor secured thereon in its operating position and prevent even slight disorientation of the motor from vibrations during even long operating periods.

While in the illustrated embodiment two separate plates have been shown on the inside of the transom, it will be understood that a single plate similarly could be used which includes a pair of spaced recesses. The use of separate plates, however, permits somewhat greater flexibility in locating the recesses 38 for the screw clamps of a particular motor and also permits some saving in material. It is important, however, that the plates be mounted with their upper edges flush with the upper surface of the transom, and preferably they are sufficiently large so as to effectively protect the transom from damage during mounting of the motor.

I claim as my invention:

1. A boat transom mounting plate arrangement for removably supporting an outboard motor having a pair of U-shaped clamps which each have one arm with an adjustable clamping screw and a second substantially straight arm spaced therefrom comprising a first mounting plate secured on the rear side of said transom and having an upper edge substantially flush with the upper edge of said transom, said first plate being formed with a pair of spaced apart vertical grooves extending downwardly from the upper edge of said plate a second plate means mounted on the front side of said transom, said second plate means having an upper edge flush with the upper edge of said transom and defining a pair of recessed areas, said first plate grooves having widths substantially equal to the widths of said flat clamp arms for receiving and guiding said arms into precise lateral position on said transom so that said clamping screws are laterally aligned with said recesses and may be screwed into said recesses whereby said first plate vertical grooves and said second plate means recesses positively retain said motor in predetermined position.

2. The mounting plate arrangement of claim 1 in which the upper end of each of said vertical grooves is flared outwardly to form at least one camming surface for guiding said straight clamp arms into said grooves.

3. The mounting plate arrangement of claim 2 in which said first plate is formed with a horizontal groove extending between said vertical grooves for receiving a horizontal connecting member between said second substantially straight clamp arms.

* * * * *